US007793447B2

(12) United States Patent
Fang et al.

(10) Patent No.: US 7,793,447 B2
(45) Date of Patent: Sep. 14, 2010

(54) SIGNBOARD WITH AN LED LAMP

(75) Inventors: Hai-Ming Fang, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CH); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/420,809

(22) Filed: Apr. 8, 2009

(65) Prior Publication Data

US 2010/0139136 A1 Jun. 10, 2010

(30) Foreign Application Priority Data

Dec. 5, 2008 (CN) ..... 2008 1 0306003

(51) Int. Cl.
*G09F 13/04* (2006.01)

(52) U.S. Cl. ..... 40/544; 40/546; 362/249.02; 362/294

(58) Field of Classification Search ..... 40/544, 40/542, 550, 557, 564, 578, 579, 580, 574; 362/218, 294, 373, 800, 249.02, 311.02, 362/240, 97.1, 97.3, 431
See application file for complete search history.

(56) References Cited

U.S. PATENT DOCUMENTS

| | | | | |
|---|---|---|---|---|
| 1,962,838 | A * | 6/1934 | Regester | 40/564 |
| 4,939,029 | A * | 7/1990 | Delaney et al. | 428/314.4 |
| 5,974,710 | A * | 11/1999 | Baldwin | 40/576 |
| 6,749,320 | B1 * | 6/2004 | Hartley | 362/184 |
| 6,889,456 | B2 * | 5/2005 | Shibata et al. | 40/546 |
| 7,281,820 | B2 * | 10/2007 | Bayat et al. | 362/245 |
| 7,654,688 | B2 * | 2/2010 | Li et al. | 362/240 |
| 7,703,946 | B2 * | 4/2010 | Chiang et al. | 362/249.02 |

* cited by examiner

*Primary Examiner*—Lesley Morris
*Assistant Examiner*—Shin Kim
(74) *Attorney, Agent, or Firm*—Frank R. Niranjan

(57) ABSTRACT

A signboard integral with an LED lamp includes a lamp post and a display device mounted in the lamp post. The display device includes a box, a transparent plate mounted on an opened end of the box, a panel mounted on a side of the transparent plate and a luminous member consisting a plurality of LEDs hermetically received in the box and located at another side of the transparent plate. The panel has a plurality of holes representing marks to be shown by the signboard. Light generated by the luminous member radiates through the transparent plate and the holes of the panel to display the marks represented by the holes. The marks could be a company logo, brand, trademark or other information.

20 Claims, 3 Drawing Sheets

SIGNBOARD WITH AN LED LAMP

BACKGROUND

1. Technical Field

The present disclosure generally relates to a signboard, and more particularly to a signboard integrated with an LED lamp.

2. Description of Related Art

Nowadays, signboards are widely used in our daily life. Manufacturers of the signboards always mark logos (LOGO), such as brands, trademarks or other information on the signboards. Typically, manufacturers paint labels on the signboards for identifying brands, trademarks or other information. The signboards are usually integral with fluorescent lamps so that they can be seen in the night. However, such signboards do not have a robust structure, whereby they are often damaged due to the severe weather condition.

What is needed, therefore, is a signboard integral with an LED lamp, which has a robust structure to withstand the severe weather condition so that the signboard can have an extended life of use, without the necessity of frequent repair and maintenance.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
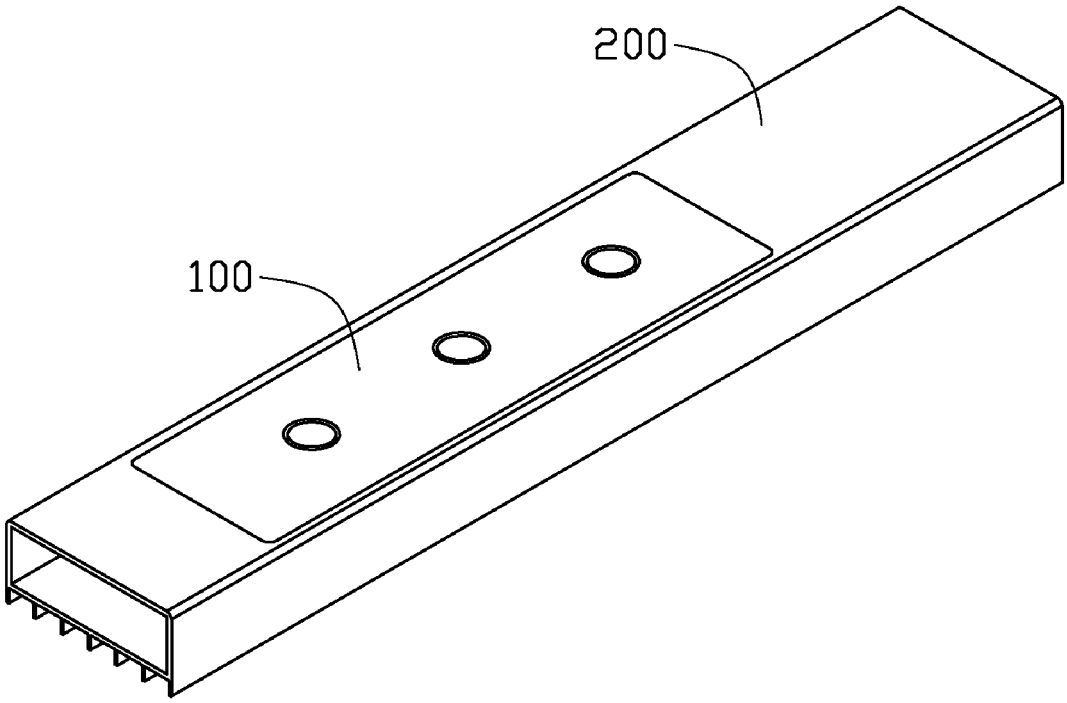
FIG. 1 is an assembled, isometric view of a signboard integrated with an LED lamp in accordance with an embodiment of the present disclosure.
Figure 2:
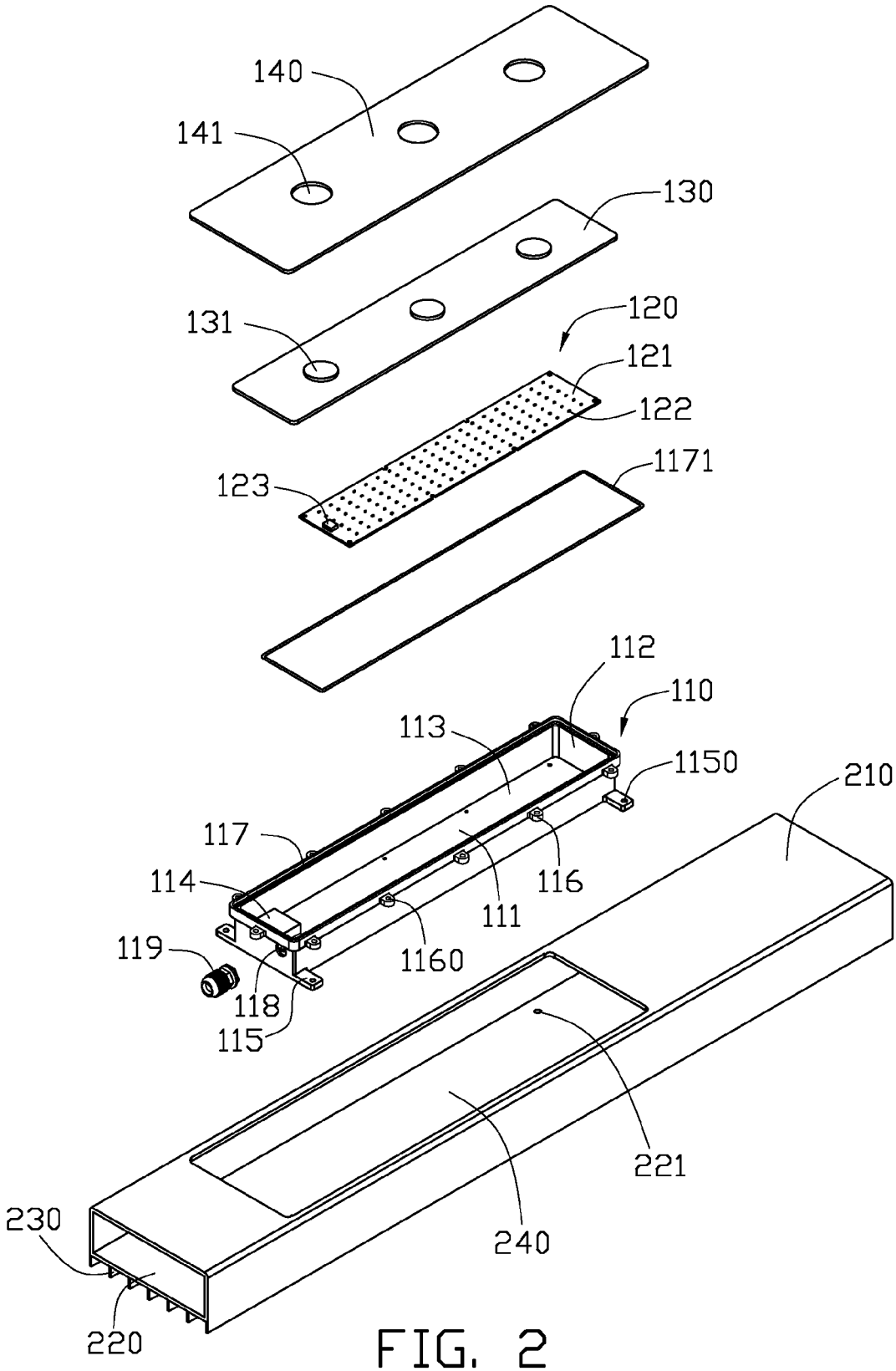
FIG. 2 is an exploded view of the signboard in FIG. 1.

Referring to FIGS. 1-2, a signboard integral with an LED lamp in accordance with an embodiment of the disclosure comprises a lamp post 200 and a display device 100 mounted on the lamp post 200 via a plurality of fasteners (not shown). The display device 100 has a substantially cuboidal configuration. The display device 100 comprises a box 110, a luminous member 120 received in the box 110, a transparent plate 130 and a panel 140 subsequently covering a top of the box 110. A driving circuit module 114 is electrically connected with the luminous member 120.

The box 110 comprises a bottom plate 111 and a circumferential wall 112 extending upwardly from a peripheral edge thereof. The bottom plate 111 and the circumferential wall 112 cooperatively form a receiving space 113 for receiving the luminous member 120 and the driving circuit module 114 therein.

Four ears 115 extend horizontally and outwardly from four corners of the bottom plate 111 and beyond the circumferential wall 112. Each ear 115 defines a threaded hole 1150 therein through which the fastener extends. A plurality of evenly spaced supports 116 extends horizontally and outwardly from a top of the circumferential wall 112. Top face of each support 116 is located below a top face of the circumferential wall 112 with a certain distance. Each support 116 defines a through hole 1160 therein. A plurality of screws (not shown) extends upwardly through the through holes 1160 and engages with the panel 140, mounting the panel 140 on the top of the box 110. The top face of the circumferential wall 112 defines an annular step 117 at an inner side thereof. A peripheral portion of the transparent plate 130 abuts the annular step 117, so that the annular gasket 1171 is sandwiched between the peripheral portion of the transparent plate 130 and the annular step 117 for preventing dust, rainwater, or other foreign matters from creeping into the box 110. An end of the circumferential wall 112 near the driving circuit module 114 defines an extending hole 118. A waterproof joint 119 is secured in the extending hole 118. Electric wires (not shown) of the driving circuit module 114 extend through the waterproof joint 119 to connect an external power supply.

The luminous member 120 is rectangular, and is mounted on the bottom plate 111 of the box 110. The luminous member 120 comprises a printed circuit board 121, a plurality of LEDs 122 attached to the printed circuit board 121 and a socket 123 located at an end of the printed circuit board 121. The socket 123 is electrically connected with the driving circuit module 114.

The transparent plate 130 is made of transparent material such as plastic, glass, or other suitable materials availing to transmit light. The transparent plate 130 protrudes a plurality of convexes 131 from a top face thereof, in this embodiment, the convexes 131 are round and have an amount of three. The shape and amount of the convexes 131 can be various according to an actual requirement. These convexes 131 represent marks (not shown) which cooperatively show a brand, a company logo, a trademark or other information needing to be displayed by the signboard. A bottom face of the transparent plate 130 is treated by sand blasting or abrasive blasting to make beams of light projecting on the transparent plate 130 becoming soft.

Figure 3:
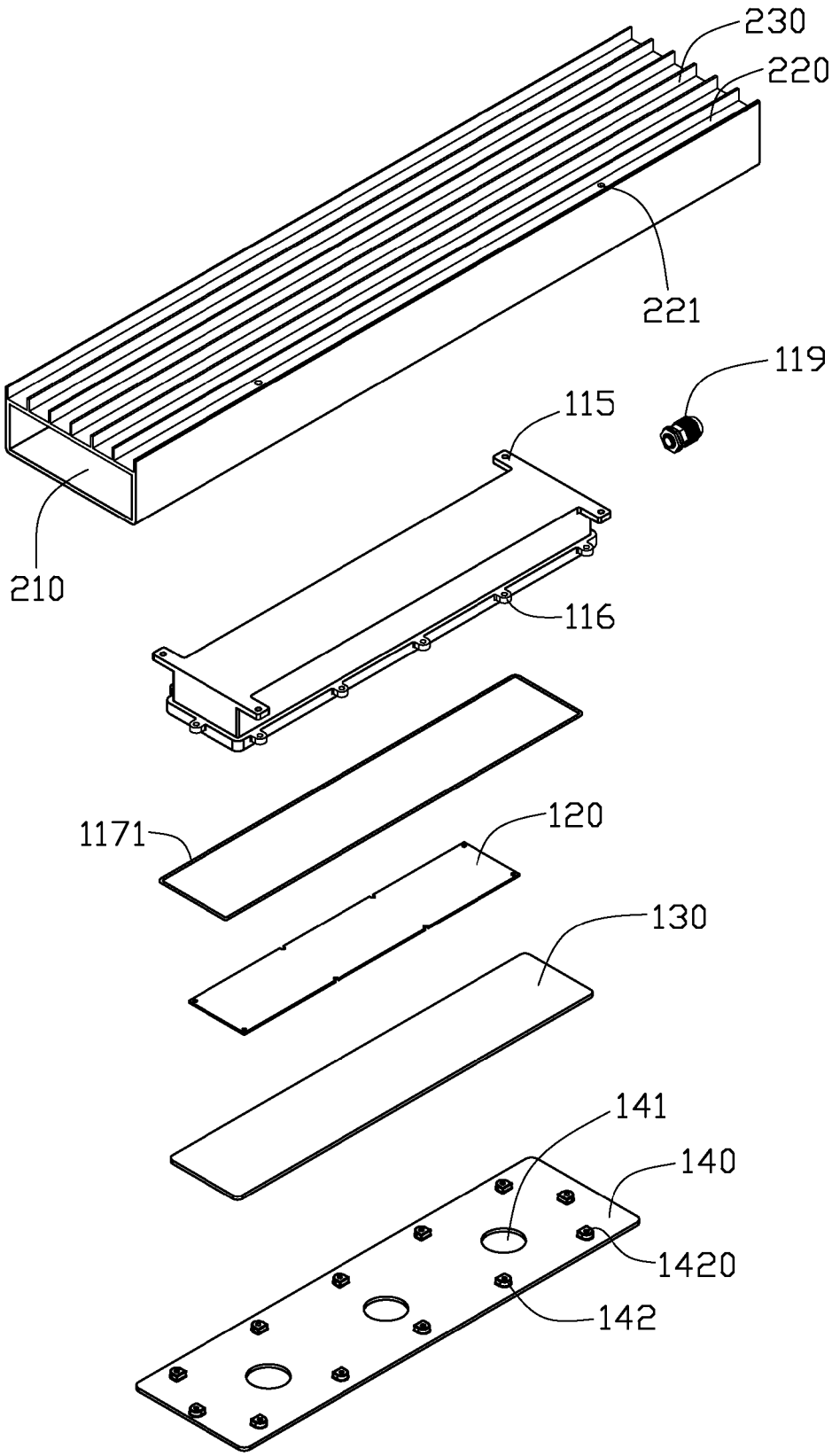
FIG. 3 is an inverted view of FIG. 2.

Referring to FIG. 3 also, the panel 140 which has a rectangular configuration, is made of opaque material. The panel 140 has three holes 141 corresponding to the convexes 131 of the transparent plate 130. A bottom face of the panel 140 protrudes a plurality of tabs 142 corresponding to the supports 116 of the box 110. Each tab 142 defines a blind hole 1420 therein corresponding to a corresponding through hole 1160 of the support 116. The screws extend through the supports 116 and engage into the blind holes 1420 of the tabs 142, thereby connecting the bottom face of the panel 140 to a top face of the circumferential wall 112 of the box 110. At the same time, the convexes 131 fittingly extend in the holes 141, so that light emitted from the luminous member 120 radiates through the convexes 131 and the holes 141 to be seen from an outside of the signboard, whereby the marks represented by the convexes 131 can be seen in the night. Alternatively, the convexes 131 can be omitted. The holes 141 themselves can represent the marks, whereby when the light radiates through the holes 141, the marks represented by the holes 141 can be seen from an outside.

Referring to FIG. 2 again, the lamp post 200 is a rectangular hollow shell. The post 200 comprises a cover 210, a mounting wall 220 and a plurality of fins 230 extending downwardly from the mounting wall 220. The cover 210 defines a rectangular hole 240. The display device 100 extends through the hole 240 and is received in the post 200. The mounting wall 220 defines four mounting holes 221 corresponding to the threaded holes 1150 of the four ears 115. The fasteners extend through the mounting holes 221 and engage with corresponding ears 115, thereby mounting the display device 100 on the mounting wall 220. Heat generated by the luminous member 120 is transferred from the bottom plate 111 of the box 110 to the mounting wall 220 of the post 200, and further dissipated to air via the fins 230.

In assembly of the signboard integral with an LED lamp, the luminous member 120 and the driving circuit module 114 are abreast mounted on the bottom plate 111 of the box 110. The transparent plate 130 presses on the gasket 1171 beforehand. The panel 140 is mounted on the top of the box 110 via the screws. At the same time, the panel 140 is attached to the top face of the transparent plate 130, and the gasket 1171 is sandwiched between the transparent plate 130 and the annular step 117 to prevent foreign matters from creeping into the box 110. Therefore, the assembly of the display device 100 is completed. The display device 100 is mounted on the mounting board 220 of the post 200. Atop face of the display device 100 is coplanar with that of the cover 210 of the post 200.

One advantage of the signboard of the disclosure is that the luminous member 120 and the driving circuit board 114 are hermetically received in the box 110, whereby the luminous member 120 and the driving circuit board 114 will not be wetted to have a short circuit. Furthermore, the heat generated by the LEDs 122 is dissipated to the air by the fins 230, whereby the LEDs 122 can work normally for an extended period of time. Finally, the display device 100 can be disassembled from the lamp post 200 to facilitate the maintenance and repair of the driving circuit board 114 and the luminous member 120.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A signboard integral with an LED lamp comprising:

a lamp post; and a display device mounted in the lamp post, the display device comprising a box, a luminous member consisting of a printed circuit board and a plurality of LEDs mounted on the printed circuit board being hermetically received in the box, a transparent plate mounted on an opened end of the box, a panel mounted on the transparent plate, the panel having holes representing marks to be shown by the signboard;

wherein light emitted from the luminous member radiates through the transparent plate and the holes of the panel so that the marks represented by the holes of the panel can be seen from an outside of the signboard;

wherein the lamp post is a rectangular hollow shell;

wherein the lamp post comprises a cover and a mounting wall corresponding to the cover, the cover defines a hole so that the display device extends through the hole and is mounted on the mounting wall; and wherein the box of the display device comprises a bottom plate and a circumferential wall extending upwardly from a peripheral edge thereof, a plurality of ears extending horizontally and outwardly from corners of the bottom plate and beyond the circumferential wall.

2. The signboard as claimed in claim 1, wherein the display device further comprises a gasket, a top of the circumferential wall defining a step at an inner side thereof.

3. The signboard as claimed in claim 2, wherein the gasket is sandwiched between a peripheral portion of the transparent plate and the step for preventing dust, rainwater, or other foreign matters from creeping into the box.

4. The signboard as claimed in claim 3, wherein a top of the circumferential wall extends outwardly and horizontally a plurality of supports, a bottom face of the panel protruding a plurality of tabs corresponding to the supports, a plurality of screws extending upwardly through the tabs and engaging with the supports for mounting the panel on a top of the box.

5. The signboard as claimed in claim 4, wherein the supports are evenly spaced from each other.

6. The signboard as claimed in claim 1, wherein the display device further comprises a driving circuit module received in the box and electrically connected with the luminous member and a waterproof joint mounted on the circumferential wall for extension of electric wires of the driving circuit module therethrough to connect an external power supply.

7. The signboard as claimed in claim 1, wherein the transparent plate has a plurality of convexes thereon, the convexes being fittingly extended in the holes of the panel.

8. The signboard as claimed in claim 1, wherein a bottom face of the transparent plate is treated by sand blasting or abrasive blasting to make beams of light projecting on the transparent plate becoming soft.

9. The signboard as claimed in claim 1, wherein the holes in the panel form one of a company logo, a brand, a trademark.

10. A signboard integral with an LED lamp comprising:

a lamp post; and a display device mounted in the lamp post, the display device comprising a box, a luminous member consisting of a printed circuit board and a plurality of LEDs mounted on the printed circuit board being hermetically received in the box, a transparent plate mounted on an opened end of the box, a panel mounted on the transparent plate, the panel having holes representing marks to be shown by the signboard;

wherein light emitted from the luminous member radiates through the transparent plate and the holes of the panel so that the marks represented by the holes of the panel can be seen from an outside of the signboard;

wherein the lamp post is a rectangular hollow shell;

wherein the lamp post comprises a cover and a mounting wall corresponding to the cover, the cover defines a hole so that the display device extends through the hole and is mounted on the mounting wall; and wherein the lamp post further comprises a plurality of fins extending downwardly from the mounting wall, the fins dissipating heat generated by LEDs of the luminous member.

11. The signboard as claimed in claim 10, wherein a bottom face of the transparent plate is treated by sand blasting or abrasive blasting to make beams of light projecting on the transparent plate becoming soft.

12. The signboard as claimed in claim 10, wherein the holes in the panel form one of a company logo, a brand, a trademark.

13. The signboard as claimed in claim 10, wherein the transparent plate has a plurality of convexes thereon, the convexes being fittingly extended in the holes of the panel.

14. The signboard as claimed in claim 10, wherein a top face of the display device is coplanar with that of the cover of the lamp post.

15. The signboard as claimed in claim 10, wherein the box of the display device comprises a bottom plate and a circumferential wall extending upwardly from a peripheral edge thereof, a plurality of ears extending horizontally and outwardly from corners of the bottom plate and beyond the circumferential wall.

16. The signboard as claimed in claim 15, wherein the display device further comprises a gasket, a top of the circumferential wall defining a step at an inner side thereof.

17. The signboard as claimed in claim 16, wherein the gasket is sandwiched between a peripheral portion of the transparent plate and the step for preventing dust, rainwater, or other foreign matters from creeping into the box.

18. The signboard as claimed in claim 17, wherein a top of the circumferential wall extends outwardly and horizontally a plurality of supports, a bottom face of the panel protruding a plurality of tabs corresponding to the supports, a plurality of screws extending upwardly through the tabs and engaging with the supports for mounting the panel on a top of the box.

19. The signboard as claimed in claim 18, wherein the supports are evenly spaced from each other.

20. The signboard as claimed in claim 15, wherein the display device further comprises a driving circuit module received in the box and electronically connected with the luminous member and a waterproof joint mounted on the circumferential wall for extension of electric wires of the driving circuit module therethrough to connect an external power supply.

* * * * *